United States Patent [19]

Yang

[11] Patent Number: 5,028,915

[45] Date of Patent: Jul. 2, 1991

[54] DEVICE FOR CONTROLLING A DISPLAY WITH A PLURALITY OF STRINGS OF LIGHT-EMITTING ELEMENTS

[76] Inventor: Michael Yang, 4 Fl., No. 28, Lane 42, Tung Kuang Rd., Hsin Chu City, Taiwan

[21] Appl. No.: 399,084

[22] Filed: Aug. 24, 1989

[51] Int. Cl.[5] ..... G09G 3/32; G09G 3/26

[52] U.S. Cl. ..... 340/782; 340/724; 340/815.02; 340/792

[58] Field of Search ..... 340/724, 726, 740, 749, 340/762, 780, 782, 802, 803, 815.02, 815.03, 815.18, 815.19, 815.24, 815.27, 792; 315/169.2

[56] References Cited

U.S. PATENT DOCUMENTS

| | | | |
|---|---|---|---|
| 3,651,511 | 3/1972 | Andrews et al. | 340/780 |
| 3,909,822 | 9/1975 | Lee et al. | 340/780 |
| 4,262,292 | 4/1981 | Duley | 340/762 |
| 4,359,730 | 11/1982 | Kunikane et al. | 340/792 |
| 4,647,927 | 3/1987 | Ichikawa et al. | 340/792 |
| 4,771,278 | 9/1988 | Pooley | 340/780 |
| 4,841,200 | 6/1989 | Cleary, Jr. et al. | 340/782 |

*Primary Examiner*—Jeffery A. Brier
*Assistant Examiner*—M. Fatahiyar
*Attorney, Agent, or Firm*—Poms, Smith, Lande & Rose

[57] ABSTRACT

A device for controlling a display with a number of strings of light-emitting elements (particularly bulbs) connected in series to offer a aesthetically favorable jeu de lumiére, having, apart from a timing generator and a driving circuit for the display, a read only memory ROM, a programmable logic array PLA, two dividers and two address counters. With this device, all the aesthetically practical patterns can be repeated in desired times with varying speeds while requiring a very small storage capacity of the ROM, thus considerably saving the cost of production.

8 Claims, 13 Drawing Sheets

ROM

| ADDRESS | Data X.Y. (Dynamic patten) | | Data Z (Display how long?) | Data W (Interval of an image) |
|---|---|---|---|---|
| | Column (X) | Row (Y) | | |
| 1 | 1 | 1 | 400 tu (for 100 times) | 1 tu |
| 2 | 1 | 1 | 400 tu (for 50 times) | 2 tu |
| 3 | 3 | 1 | 800 tu (for 100 times) | 4 tu |
| 4 | 1 | 2 | 400 tu (for 100 times) | 1 tu |
| 5 | ⋮ | ⋮ | ⋮ | ⋮ |

FIG. 5A.

DEVICE FOR CONTROLLING A DISPLAY WITH A PLURALITY OF STRINGS OF LIGHT-EMITTING ELEMENTS

The present invention relates to a device for controlling a display with a plurality of strings of light-emitting elements (especially bulbs).

A such large display consists of a number of strings of bulbs. Each string comprises a leader bulb and a number of follower bulbs connected in series, thus all the bulbs in a string light up and go out synchronously. Thus by controlling the ON/OFF of each string, the blinking of the whole display can be controlled to give a "jeu de lumière".

To cause a changeable blinking of such a display, there are three conventional ways, which, in principle, respectively involve:

(A) breaking the circuit by thermal expansion:

(B) controlling the blinking by means of a random selection of outputs from a random number generator; and (C) using a ROM which stores all the steps of a period.

Referring to FIG. 1, in the first method, each string 1 of bulbs has a leader bulb 10 which is provided with a thermally expandable contact 11. When a leader bulb 10 lights up, the heat from its filament causes the contact 11 to expand, thus resulting in the detachment of the contact points thereof, so the leader bulb 10 is no longer supplied and turns out and all the remaining bulbs (follower bulbs) 12 also go out. Now the contact 11 no longer receives the heat from the leader bulb 10 and cools down, causing the contact points to contact with each other, therefore the leader bulb 10 and the follower bulbs 12 light up again. According to this method, the ON/OFF time of a bulb depends on several uncontrollable factors and is therefore totally unpredictable. The resulting jeux de lumière offer a viewer very little sense of beauty. The reason is simple. In aesthetics, there are some main factors which are often associated with the sense of beauty, namely changeability, harmony, balance and a certain regularity (symmetry and rhythm). Since the moment and duration of the ON/OFF of the bulbs are totally uncontrollable, it is impossible to harmonize or to rhythmize the blinking of the strings of bulbs. As a result, the jeux de lumière, while changeable, are totally unorganized, disharmonious and rhythmless, and therefore far from beauty.

According to the second method, a random number generator 2, which has a plurality of output terminals 21 each corresponding to a string of bulbs 1', is provided. As shown in FIG. 2, two oscillators 22 and 23 of different frequencies are connected to the inputs of a comparator 24 to produce a so-called "random number effect". Thus a rhythmical output (each time outputting a random number) is sent to a counter 25, which in turn sends out a HIGH output from one of its output terminals 21, depending on the count of the random number, thus causing a somewhat rhythmical yet randomly selected lighting-up of the strings of bulbs 1'. Needless to say, the resultant jeux de lumière are changeable and, in comparison with the first method, more rhythmical. Nevertheless, since it is totally unpredictable as to which string of bulbs will light up in the next turn, the resultant jeux de lumière still fail to offer the viewer the senses of harmony, balance and symmetry, which must be produced by even, proper distribution of the occurrence of ON throughout all the strings of bulbs (and also, a certain repetition is necessary to emphasize the symmetry).

The third method is directed to solving this problem. In this method, the desired jeux de lumière are predetermined, thus offering the necessary senses of harmony, balance and symmetry. Referring to FIG. 3, a device for this method comprises an oscillating circuit 30, a timing (clock) generator 31, an address counter 32, a ROM 33 and a known driving circuit 34 to drive a display comprising a number of strings of bulbs [here only four strings of bulbs a, a1, a2, b, . . . d2 are shown]. The data structure of the ROM 33 and the fetching of the data thereof is described in the following.

Referring to FIG. 4, suppose the dynamic blinking pattern is produced by the continuous change from a static yet very transient "image" into another "image" (just as a dynamic movie is produced by the continuous substitution of one static "frame" by another "frame"), and suppose an image is given for each interval of unit time tu, then the image formed by the four bulb strings can be represented by a four-bit datum. [Since all the bulbs in a string, for example a, a1, a2, light up and go out synchonously, we only need to use the ON/OFF state of one bulb, for example a, to represent the ON/-OFF of the whole string.] For example, at the moment t=1 tu, the image is: bulb a (ON) bulb b (OFF) bulb c (OFF) bulb d (OFF), so the data of this image is stored in the first address in the ROM in form of a binary code 1000. According to this example, the ROM 33 sends out a four-bit datum for every unit time tu. The timing generator 31 sends a clock of period tu. Thus when t=1 tu, the address count is 1 so that a signal is sent via an address bus AB to the first address of the ROM, and the data 1000 in the first address of the ROM is sent via a data bus DB to the driving circuit 34 to cause an image a (ON) b (OFF) c (OFF) d (OFF). When t=2 tu, the address counter 32 receives another clock from the timing generator 31 and the address count is shifted by 1, thus indicating the second address. Thus the data (0100) in the second address is sent to the driving circuit to cause an image a (OFF) b (ON) c (OFF) d (OFF). Since the displayed images change with the rhythmic clocks, the resultant jeux de lumière are rhythmically agreeable. Moreover, the designer has the greatest freedom to properly chose some beautiful dynamic patterns and arrange them in proper order to give an aesthetically agreeable jeu de lumière.

[Note: Here we must make a clear definition for the terminology. An "image" means a static scene resulting from a plurality of bulbs which may be ON or OFF. For example, the instantaneous state, that only the first string of bulbs in ON, means that an image a (ON) b (OFF) c (OFF) d (OFF) is being displayed.]

A "dynamic pattern" is a procedure going through a limited number of image which offers a specific impression. For example, a dynamic pattern of the impression "a bright line sweeping rightward" means a sequence of four images corresponding to 1000, 0100, 0010 and 0001; a dynamic pattern of the impression "a dark line sweeping rightward" results from 0111, 1011, 1101 and 1110; and a dynamic pattern giving the impression "blinking" results from alternating 1111 and 0000.

A "jeu de lumière" is a showy process resulting from the ON/OFF of a number of consecutive "dynamic patterns". For example, a "jeu de lumière" can be "a single bright line sweeps rightward for 100 times, then the display blinks for 200 times, and finally a dark line sweeps leftward for 100 times." Such a cycle involves $(4\times100)+(2\times200)+(4\times100)=1200$ images.

From aesthetical points of view, the third method is successful. But it has a disadvantage that its demand for storage space is formidably high. Suppose the frequency of the clock signals sent into the counter 32 is 20 Hz, then in each unit time ($tu=1/20=0.05$ sec) a four bit datum is sent to the driver 34. Thus a jeu de lumière which lasts for 200 seconds for each cycle will require a read only memory (ROM) of 4 bits$\times20\times200=16K$ bits to store all the images therein. The cost associated with such a high storage capacity of read only memory is considerable. Moreover, when a cycle of the jeu de lumière ends (i.e., all the image data stored in the ROM are displayed), generally another cycle begins, re-displaying the data from the first address to the last address. The invariable cyclic repetition of the same jeu de lumière, after a few repeated cycles, may become less attractive.

Accordingly, it is a main object of the present invention to provided an improved device to obviate the aforesaid disadvantages of the conventional technique.

The disadvantage of the aforesaid third method largely results from its uneconomical data structure. For example, if we desire to display a dynamic pattern "a bright line sweeping rightward" three times, we have to store three like sets of data (1000, 0100, 0010 and 0001) in twelve consecutive addresses, and not a single set in four consecutive addresses. If we desired to display the same pattern at a slower speed of its motion (e.g. the "sweeping" speed is only one half that of the normal state), we have to store like images in consecutive pairs of addresses. Namely, we have to store 1000, 1000, 0100, 0100, 0010, 0010, 0001 and 0001 in eight (four pairs) consecutive addresses, and not in merely four addresses. Thus it is obvious, that in the case of repeated occurrence or varying speed of the same "dynamic patterns", the storage space is use in a very uneconomical manner.

Though innumerable possible "dynamic patterns" can be obtained by the third method, only a limited number among them are really aesthetically useful. In fact, in the displays involving the third method which are practically used, the "dynamic patterns" of the resultant "jeux de lumière" can be analyzed into no more than a few dozens of different types. Examples of the frequently used dynamic patterns are "a bright (or dark) line sweeping rightward, or leftward", "a bright (or dark) line reciprocating" (the reciprocation can also be regarded as an alternate rightward and leftward sweeping), "a bright (or dark) band of two-bulb width sweeping rightward, leftward, or reciprocating" or "blinking", etc. In most cases, these "dynamic patterns" often present in a jeu de lumière in form of repetition or with varied speed of their motions. Other irregular changes or sporadic appearance of some special patterns are seldom used. For example, in a jeu de lumière, we can often see a bright line sweeping rightward for 100 times at its normal "sweeping speed", then it keeps on sweeping rightward for another 50 times at a slower speed one half that of its precedent speed, and subsequently blinks 200 times at normal speed, . . . and so forth. (Here the "normal speed" means that an image changes into another different image at an interval equal to the period of a time unit tu.)

Since in practical use, these dozens of dynamic patterns are often repeated or displayed at varying speeds, the ROM is always used in an extremely uneconomical way.

In face, these dozens of dynamic pattern themselves, if not displayed repeatedly or at varying speed, only occupy a very small space of storage, which a known PLA (programmable logic array) is more than enough to provided.

Therefore, according to the present invention, a PLA of $m\times n$ matrical positions is provided (m,n are positive integers). Each of the $m\times n$ matrical positions may store a respective "dynamic pattern" of the aforesaid dozens of practical dynamic patterns which a display can offer, or may be left vacant if the number of matrical positions $m\times n$ is greater than the total number of the dynamic patterns to be stored in the PLA. [The reason why vacant positions may exist is simple. The number $m\times n$ of an available PLA may not always just coincide with the number of the desired dynamic patterns. In such case, the number $m\times n$ must be greater than that of the dynamic patterns. Thus a certain vacant matrical positions may be left.] In so doing, we can use a PLA and a ROM of low storage capacity, both being inexpensive, instead of a ROM of high storage capacity which is extremely costly, thereby greatly reducing the cost of production while not diminishing the aesthetical value of the display.

The storage capacity of a matrical position of the PLA must be sufficient to store all the bits of an assigned dynamic pattern. Referring to FIGS. 5A to 5C, if the dynamic pattern, "a bright line sweeping rightward", is stored in the matrical position $P_{11}$ in the PLA, then the storage capacity of $P_{11}$ must be sufficient to receive the data 1000, 0100, 0010 and 0001, totaling 16 bits. The number of the matrical positions depends on the number of the desired dynamic patterns, while the capacity of each matrical position is a term of the scale of the display (i.e. the number of the bulb strings thereof).

In order to select a dynamic pattern out of the dozens of practical dynamic patterns stored in the PLA, the ROM must store, instead of the data of the dynamic pattern itself, the data corresponding to its matrical position (i.e. the column number X and row number Y of a matrical position $P_{XY}$). If the dynamic pattern of $P_{11}$ is to be selected, then the data of $P_{11}$ (i.e., its column number $X=1$ and row number $Y=2$) are stored in the ROM. Thus when the address count is 1, then ROM will send a corresponding signal to the first column and first row of the PLA (i.e., $P_{11}$) to initiate the dynamic pattern therein. In order to repeatedly display the same dynamic pattern for several (for example 100) times without correspondingly storing the data of the same matrical position (for example, $P_{11}$) in several consecutive addresses in the ROM(for example, since otherwise we would have to store the data of $P_{11}$ (i.e. $X=1$, $Y=1$) for one hundred times in the ROM from its 1st address to 100th address), the data corresponding to how many consecutive times the same dynamic pattern is to be displayed are also stored in the ROM. But, practically, it is not the number of consecutive displaying (for example, 100 times), but the data corresponding tc the total duration (data Z) of the consecutive displaying (for example, here the total duration $100\times4$ tu$=400$ tu, so $Z=400$) that is stored in the ROM. The reason will be explained later.

In order to display the same dynamic pattern at different speed of motion (for example, at a slower "sweeping speed" or "blinking speed") without thereby necessitating additional matrical positions in the PLA, the data of "interval of the same image" (data W) of a dynamic pattern is also stored in the ROM. For example, if the dynamic pattern, "a bright line sweeping rightward", is to be displayed at a lower speed (for example, one half that of the normal speed), it is desired that we can still use the same dynamic pattern without storing another dynamic pattern with the image data 1000, 1000, 0100, 0100, 0010, 0010, 0001 and 0001, in another matrical position in the PLA.

In this case, the interval of the same image is doubled (i.e., the interval becomes 2 tu), so the data W=2 tu is stored in the ROM. Thus when the address count is 2, the data W corresponding to the interval of the duration of each image of the dynamic pattern in the second address of the ROM is W=2 tu, so the duration of each image of the dynamic pattern is doubled. As a result, the "sweeping speed" of the bright line is halved.

This measure to slow down the motion speed of a dynamic pattern is advantageous, or more accurately speaking, indispensable for this invention. The reason is simple. If we separately store the dynamic pattern of "a bright line sweeping rightward" of different sweeping speed in different matrical positions in the PLA, then for ten different sweeping speeds we will need ten matrical positions for the ten dynamic patterns which differs with each other only in their sweeping speeds. This is an extremely uneconomic use of matrical positions. Moreover, if we desire to obtain a sweeping speed which is only 1/20 of the normal sweeping speed, the "dynamic pattern" will contain $4\times20=80$ images, which requires a 320 bit storage space. This may far exceed what a single matrical position of a cheap PLA can receive.

Therefore each address of the ROM contains three kinds of data, namely the data of column number X and row number Y of the matrical positions of the desired dynamic pattern, the relevant value Z as to how long a duration the same dynamic pattern is to be consecutively displayed, and the displayed interval W of an image.

To realize the repetition of the same dynamic pattern, a first divider means must be provided between the timing generator and the address counter for the ROM. Thus when a dynamic pattern is to be displayed for 100 consecutive times, the data 400 tu will be sent from the ROM to the first divider means which will make a "divide-by-400 function", so that it outputs only a single signal to the address counter after receiving 400 clocks from the timing generator. Therefore, the address count does not shift from 1 to 2 during the 400 clocks, so the dynamic pattern stored in $P_{11}$ is consecutively displayed for 100 times. Then the address count is shifted to 2.

To realize the "multiplication of interval of the images", a second divider means must be provided between the timing generator and the PLA. Thus when the address count becomes 2, the ROM will send the data of interval 2 tu to the second divider means. The second divider means will perform a "divide-by-two function". Thus when two clocks are applied to the second divider means, only a signal is given from its output to the PLA. Therefore only a single "image" is displayed during the two clocks. Thus the duration of interval of each image is doubled. As a result, the sweeping speed of the bright line is halved.

Practically the first and second divider means can be either a programmable counter or a multiplexer.

As stated before, the data corresponding to how many times the same display is consecutively displayed is not the number of times of the consecutive displaying, but the total duration (data Z) thereof. The reason is simple. The data of total duration (for example, 400 tu) can be directly sent to the first divider means to make the necessary shifting of address, without regarding to whether the data W is 1 tu, 2 tu or another multiple of tu. But if we store this data in form of the number of times (for example, 100 times), this data still has to be converted into the total duration by multiply the 100 with the number of images in a dynamic pattern (for example, the dynamic pattern in $P_{11}$ has four images) and the interval of each image (for example, 1 tu), thus giving $100\times4\times1=400$ tu, which can then be sent to the first divider means.

Thus with the ROM, the desired pattern to be displayed can be determined. For example, during the stage t=400 tu to t=800 tu, when the address count of ROM is 2, the device knows that it is the dynamic pattern in $P_{11}$ that is to be displayed for 400 tu. With the second divider means, the desired clocks (with a period of 2 tu) can be sent to the correct position $P_{11}$ of the PLA.

But there is still a problem. The display gives an "image" each time. There are four images in the four addresses $P_{11-1}$, $P_{11-2}$, $P_{11-3}$ and $P_{11-4}$ of $P_{11}$. How can a clock (with a period of 2 tu) be sent from the second divider means to the correct address of $P_{11}$?

To solve this problem, a second address counter is provided between the second divider means and the PLA. Thus, if address count of the second address counter is 1, the clock from the second divider means will be sent to the address $P_{11-1}$ of $P_{11}$ to initiate the image 1000, and the address count of the second address counter, after receiving this clock, is shifted by 1 (i.e. from $P_{11-1}$ to $P_{11-2}$), so the next clock will be sent to $P_{11-2}$ to initiate the image 0100.

Therefore, the present invention comprises a PLA for storing a plurality of dynamic patterns, a ROM for storing the data X, Y, Z and W, two divider means, two address counters, and a timing (clock) generator.

This invention will be better understood when read in connection with the accompanying drawing, in which:

BRIEF DESCRIPTION OF THE DRAWINGS

FIGS. 5A to 5C are graphical representation showing the data structure of the ROM and the PLA, and three matrical positions $P_{11}$, $P_{12}$ and $P_{31}$ of the PLA;

DETAILED DESCRIPTION OF PREFERRED EMBODIMENT

Figure 1:
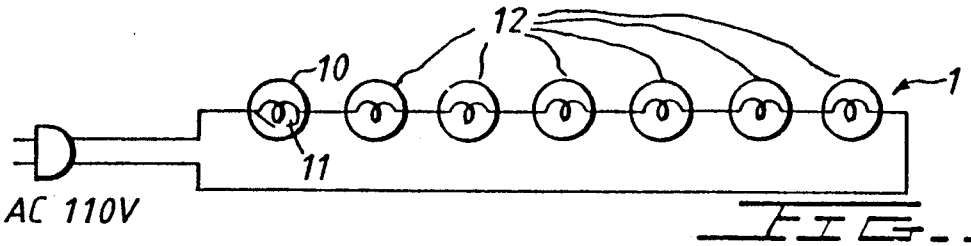
FIG. 1 shows a string of bulbs of a display using the first conventional method.
Figure 2:
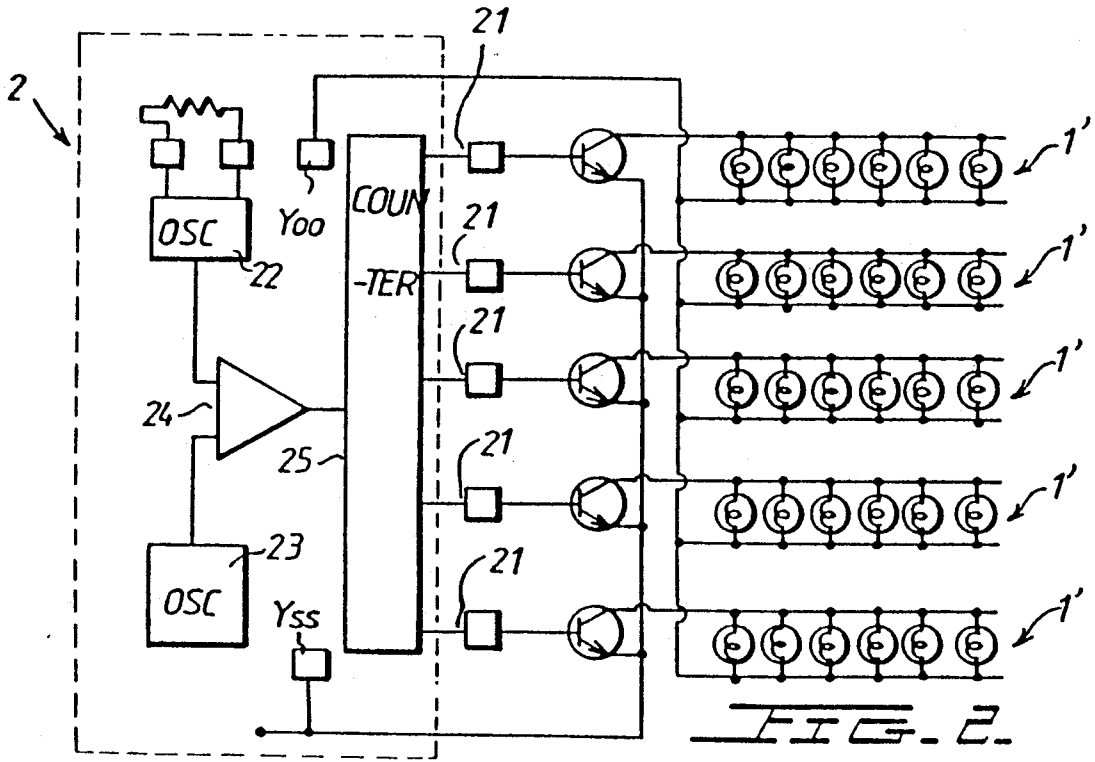
FIG. 2 is a block diagram of a known device using the second conventional method for controlling a display with strings of bulbs.
Figure 3:
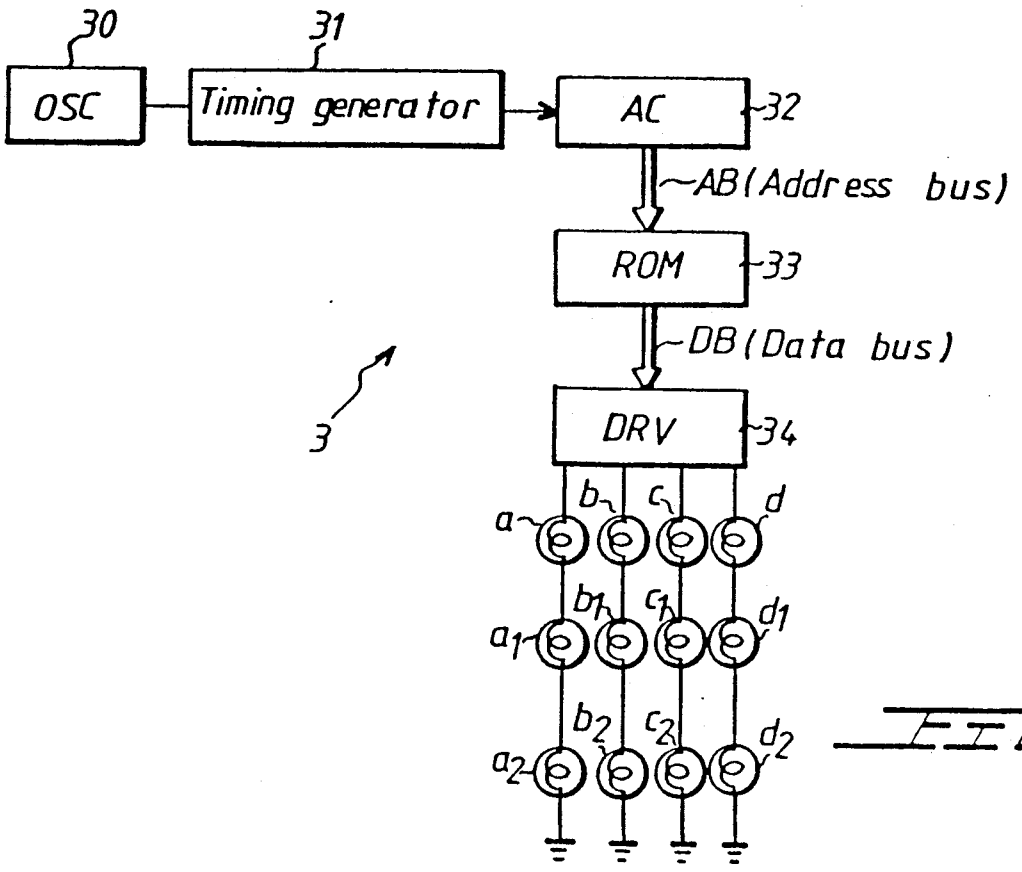
FIG. 3 is a block diagram of a known device using the third conventional method.
Figure 4:
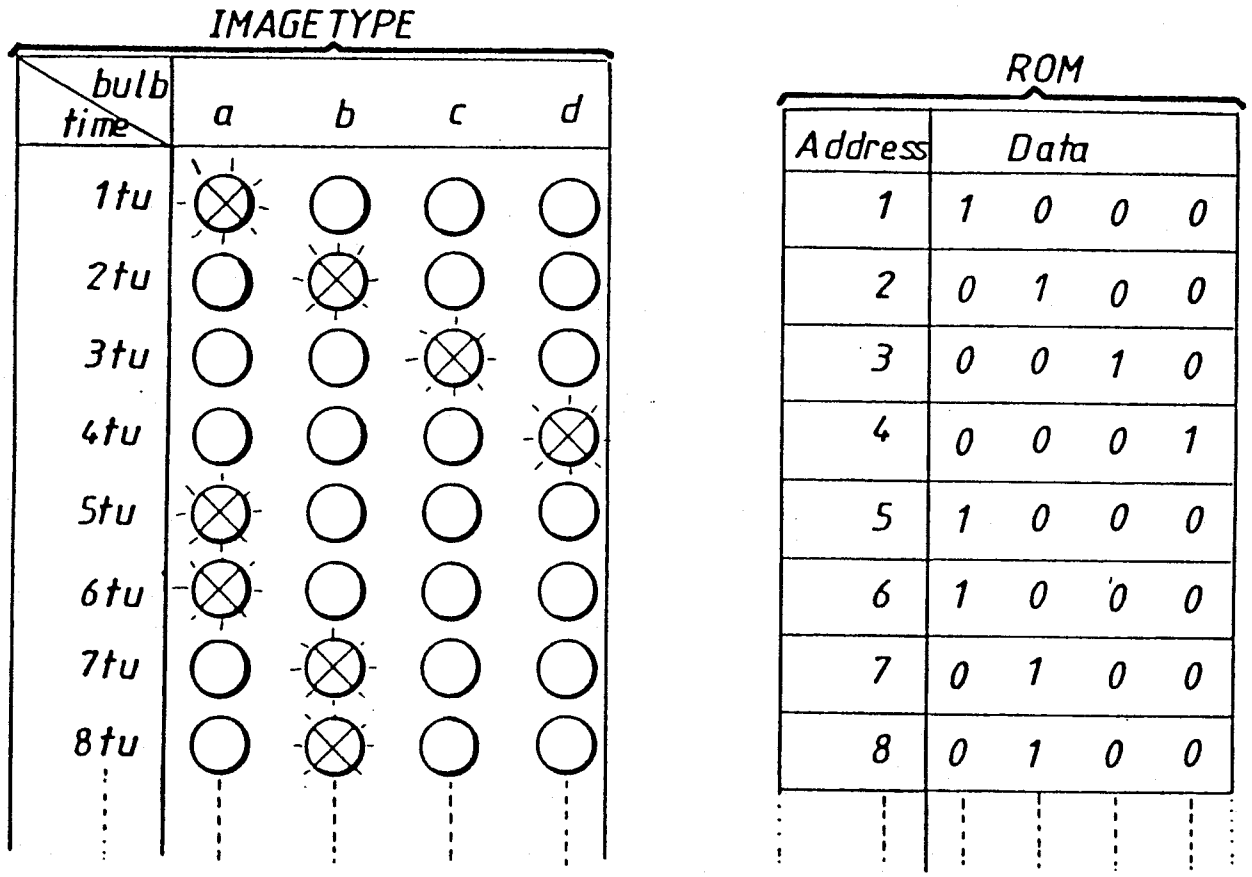
FIG. 4 is a graphical representation showing the image types and the corresponding data structure in the ROM.
Figure 5B:
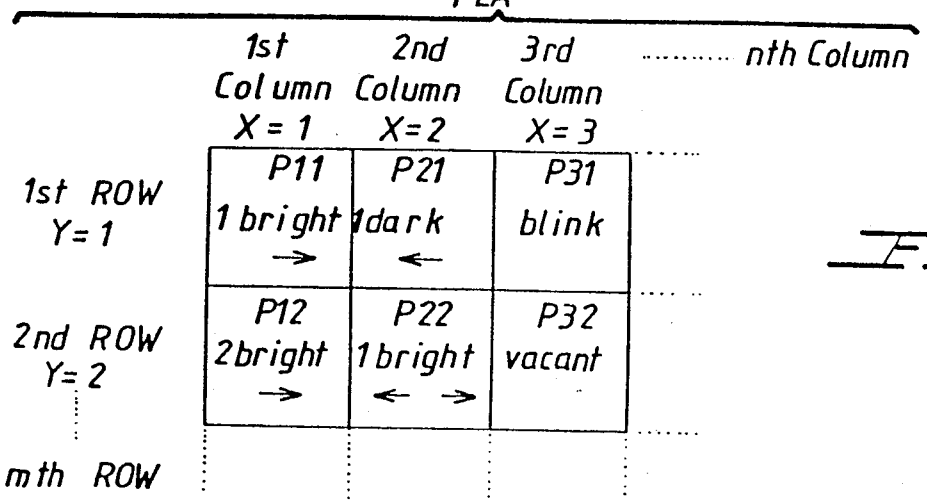
Figure 5C:
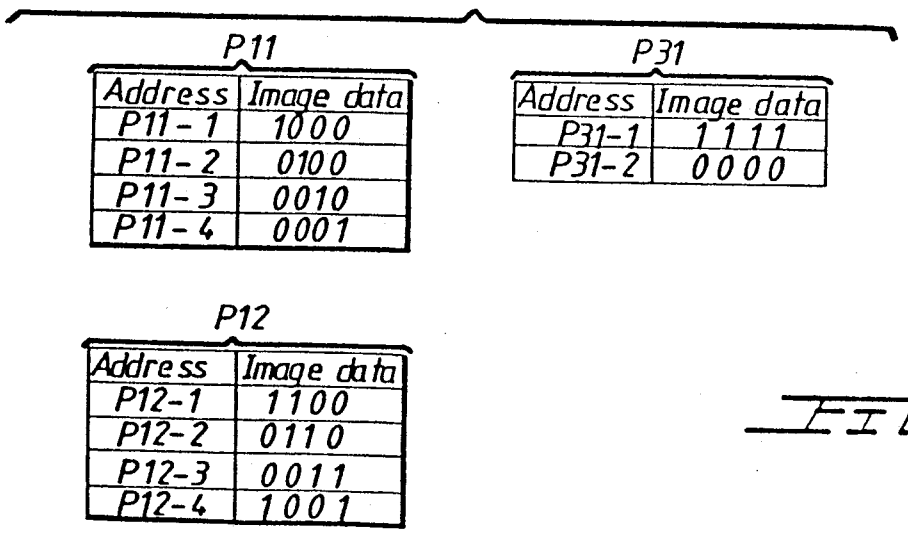
Figure 6:
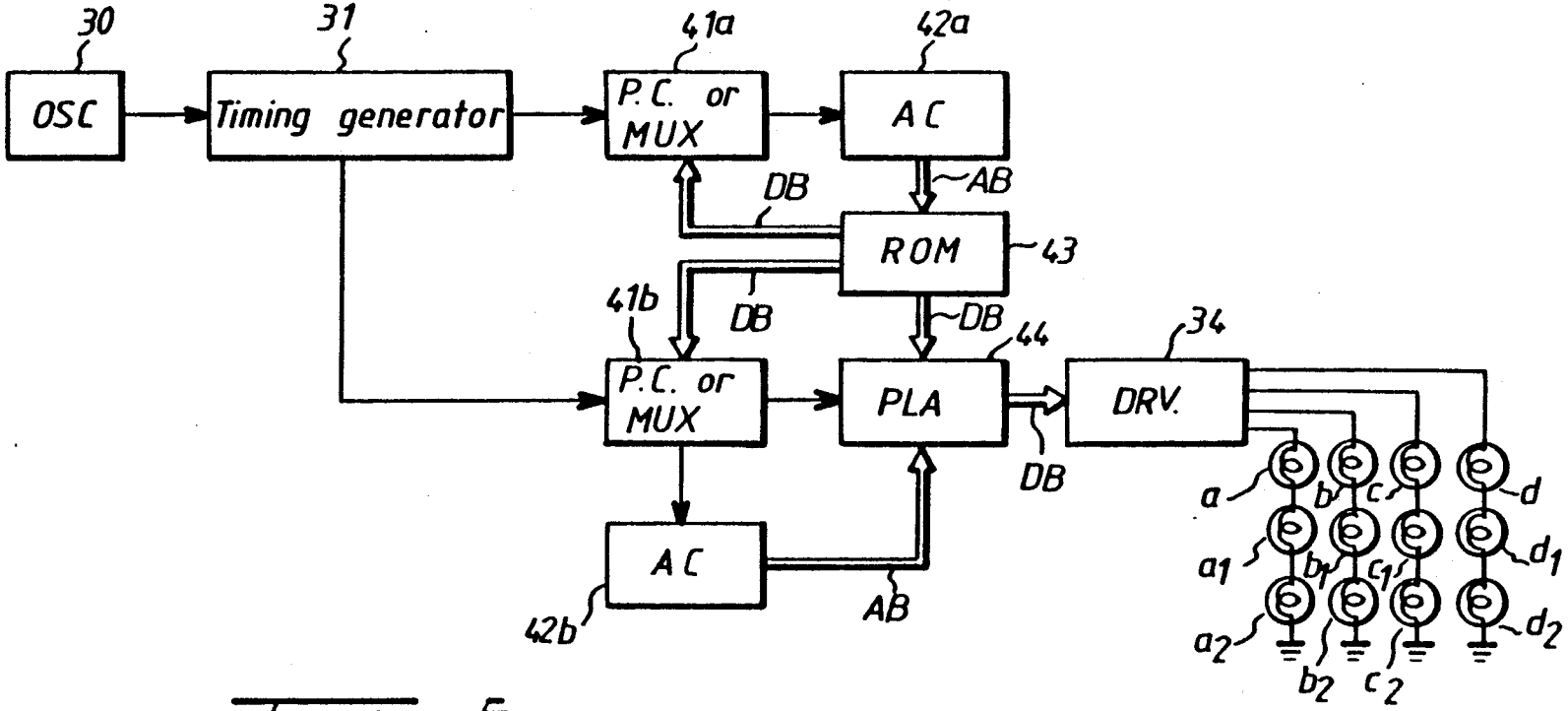
FIG. 6 is a block diagram of the device according to this invention, used to control the ON/OFF of the bulb strings only.

Referring to FIG. 6, as stated before, the device according to this invention comprises, apart from an oscillating circuit 30, a timing (clock) generator 31 and a driving circuit 34 which are exactly the same as that of the prior art in FIG. 3, a first and second divider means 41*a*, 41*b* (which can be a programmable counter or a multiplexer), a first and a second address counters 42*a*, 42*b* connected to the output thereof, a ROM 43 having a plurality of ROM-addresses to contain three kinds of data (X,Y), Z and W, and a PLA 44 having a plurality of matrical positions to store the data corresponding to the patterns. Each of the matrical positions has a plurality of PLA-position-addresses to store the data of the images of one of the patterns. In order that the data Z and W can be respectively transmitted to the first and second divider means 41*a*, 41*b*, data buses (DB) are provided to interconnect the ROM 43 and two divider means 41*a* and 41*b*.

The operating principle of this invention has been mostly described hereinbefore. Here we only use a further example to describe a procedure during a jeu de lumière. When t=800 tu, the rightward sweeping comes to an end. Now a pulse is given from the first divider means 41*a* to the first address counter 42*a*, thus the address count of the ROM 43 is shifted from two to three. Thus a corresponding signal is transmitted via a data bus of ROM 43 [in fact this "data bus" of ROM 43 is an "address bus" of PLA 44] to the $P_{31}$ of the PLA, where the data of the two images 1111, 0000 are stored. Thus in the subsequent period, before the address count in ROM shifts from 3 to 4, the PLA will cause all the bulbs a, b, c, and d to turn on or all go out when receiving a pulse from the second address counter 42*b*.

Meanwhile the data Z (800 tu) is sent from ROM 43 via another data bus to the first divider means 41*a*. The divider means 41*a* will make a "divide-by-800" function. Thus it only sends out a single pulse to the address counter 42*a* when receiving 800 consecutive clocks from the timing generator 31. So the address count of ROM is shifted to 4 after 800 tu.

At the same time, the data W (4 tu) is sent from ROM 43 via a further data bus to the second divider means 41*b* and a "divide by 4" function is thus performed. As a result, the second divider means 41*b* only gives a single pulse to the second address counter 42*b* when receiving four clocks from the timing generator 31. The second address counter 42*b* in turn transmits the pulse (of which the period is 4 tu) to an address of $P_{31}$ (for example $P_{31-1}$), depending on the address count (for example, 1) of the second address counter 42*b* to initiate the image 1111. Now the count of the second address counter 42*b* is shifted to 2. Thus the second address counter 42*b* gives a pulse to the $P_{31}$ of the PLA 44 for every 4 tu to alternately initiate the images 1111 and 0000. This results in an alternate ON/OFF of the bulbs. The period of an ON/OFF cycles is 8 tu. Thus the display blinks for 100 times during the 800 tu (from t=800 tu to t=1600 tu), with a blinking speed which is only ¼ of its normal blinking speed.

Then the address count of the ROM 43 is shifted to 4. The dynamic pattern stored in $P_{12}$ (i.e., the data of images 1100, 0110, 0011, 1001) dominates the next stage of 400 tu, when a bright band of 2-bulb width sweeps toward the right for 100 times at the normal sweeping speed.

The major part of this invention has been described hereinbefore. However, in the above example, the brightness of a bulb string in ON state is constant. In order to offer the resulting jeux de lumière more changeability, it is further desired that the brightness of the individual bulb strings which are in ON state can vary from one image to another image.

According to a further improvement of this invention, a method to control the brightness of the bulb strings is provided.

In the previous example, the ON/OFF of a bulb in each "image" corresponds to the HIGH/LOW of a bit of the corresponding image data in the PLA. In order to control the brightness of the bulb strings, the brightness of a bulb is divided, from totally dark to its brightest extent, into K different degrees. The number K is preferably the Ith power of 2 (K and I are positive integers, and practically I=3, so $K=2\times2\times2=8$) so that the different degrees can be encoded by a few (for example, three) bits. For example:

000=1st degree (OFF)
001=2nd degree
010=3rd degree
011=4th degree
100=5th degree
101=6th degree
110=7th degree
111=8th degree (brightest)

Then the brightness data of a bulb string of an image can be represented by a 3-bit data, in which 000 corresponding to the OFF of the bulb string.

Thus for a dynamic pattern, "a bright line sweeping rightward with increasing brightness from left to right", the data of the four images stored in the four addresses of a matrical position (for example, $P_{11}$) can be:

$P_{11-1}$: 001 000 000 000
$P_{11-2}$: 000 011 000 000
$P_{11-3}$: 000 000 101 000
$P_{11-4}$: 000 000 000 111

Figure 7:
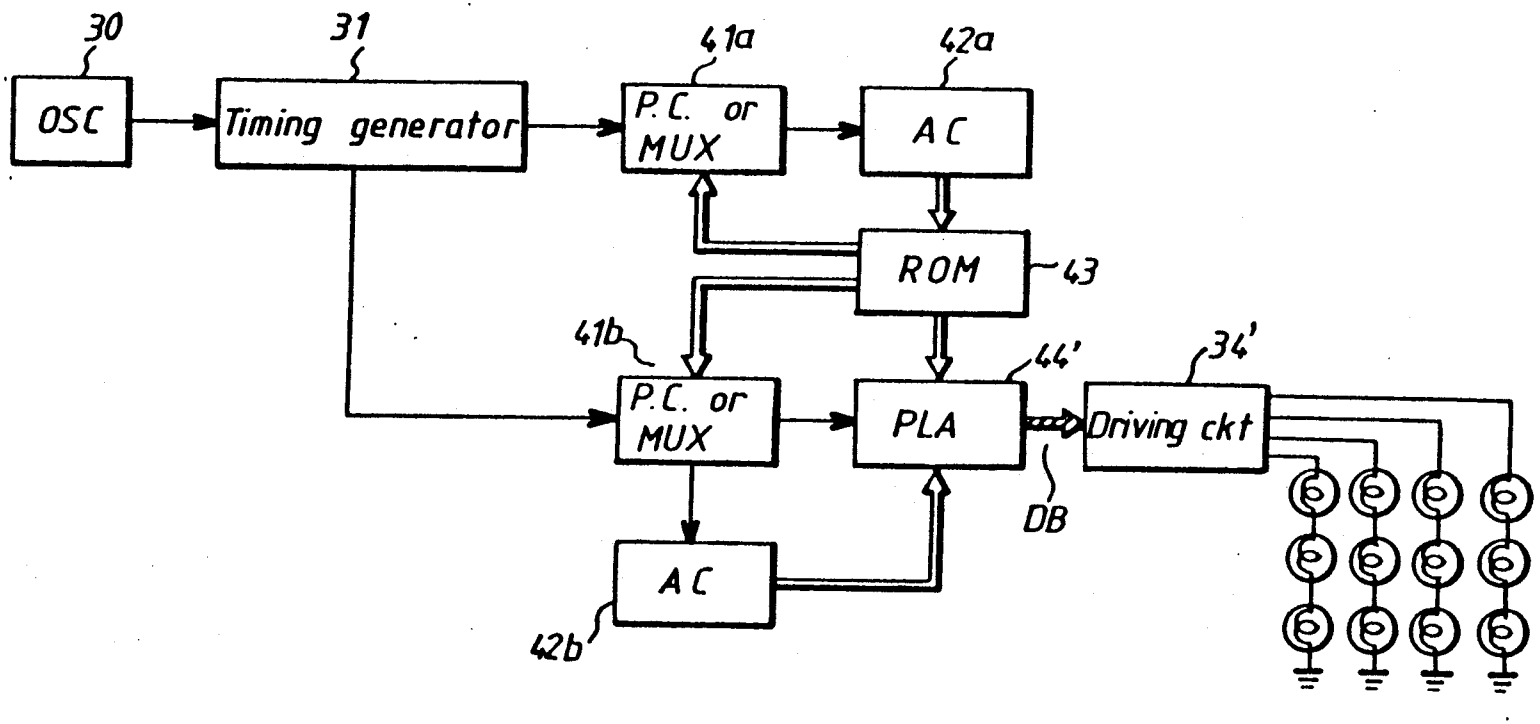
FIG. 7 is a block diagram of a further device of this invention used to control the brightness of each individual bulb strings.

FIG. 7 shows a circuit of this invention which can realize the control of brightness. It differs with the circuit in FIG. 6 only in the PLA 44', the data base from PLA to the driving circuit 34' (which is darkened by hatch lines), and the driving circuit 34' which needs a known brightness control circuit to convert the 3-bit data into a current of corresponding intensity.

To achieve the eight different degrees of brightness of the bulbs, there are two practical methods, namely:

phase lock loop (P.L.L.) method and relative frequency method.

(A) Phase Lock Loop (P.L.L.) Method

This method involves the different "conducting angle" of a wave of the power supply. The earlier the conduction is the greater the power supply will be.

Figure 8A:
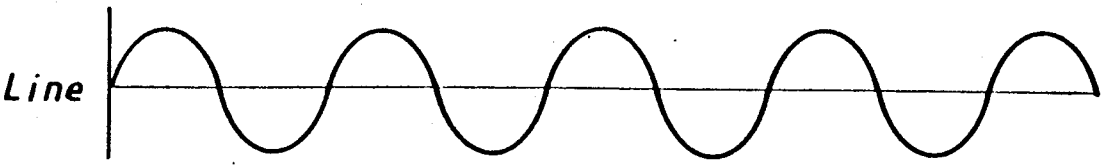
FIG. 8A is a phase diagram of an AC current.
Figure 8B:
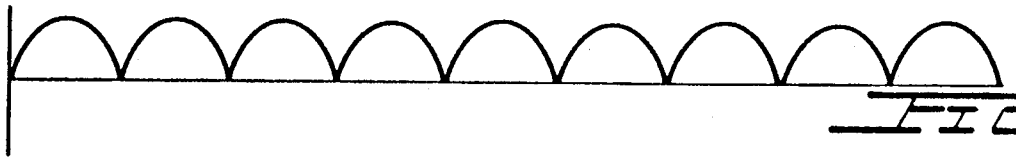
FIG. 8B is a phase diagram of a rectified current.
Figure 8C:
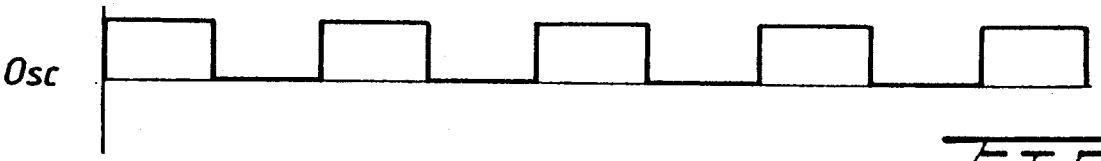
FIG. 8C is a waveform diagram of the synchronous oscillation for a decoding circuit.
Figure 8D:
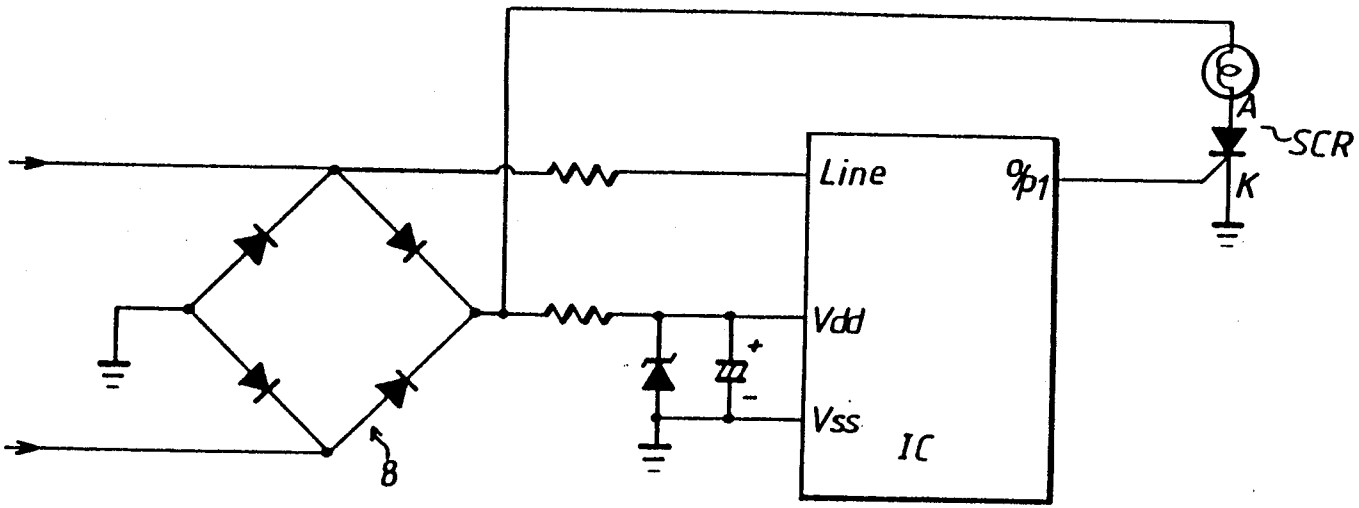
FIG. 8D is a circuit diagram for P.L.L. method.

Referring to FIGS. 8A to 8C, an AC current (FIG. 8A) is firstly rectified to a full-wave current (See FIG. 8B). The rectification is achieved by a rectifying circuit 8 (See FIG. 8D).

Figure 8E:
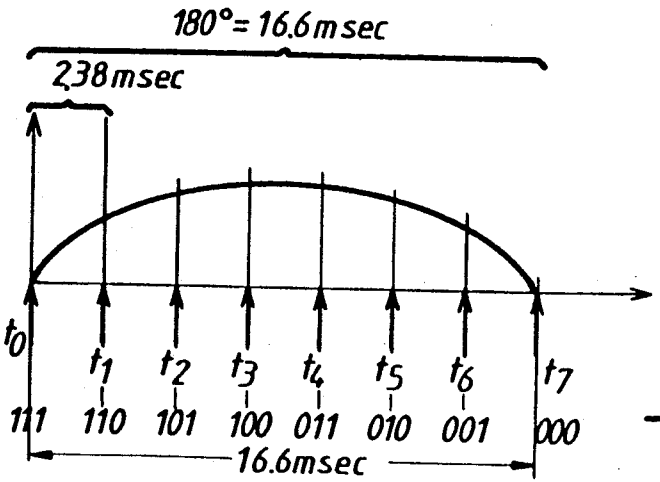
FIG. 8E is a graphical representation showing the conducting time of a wave controlled by different 3-bit data according to the P.L.L. method.
Figure 8F:
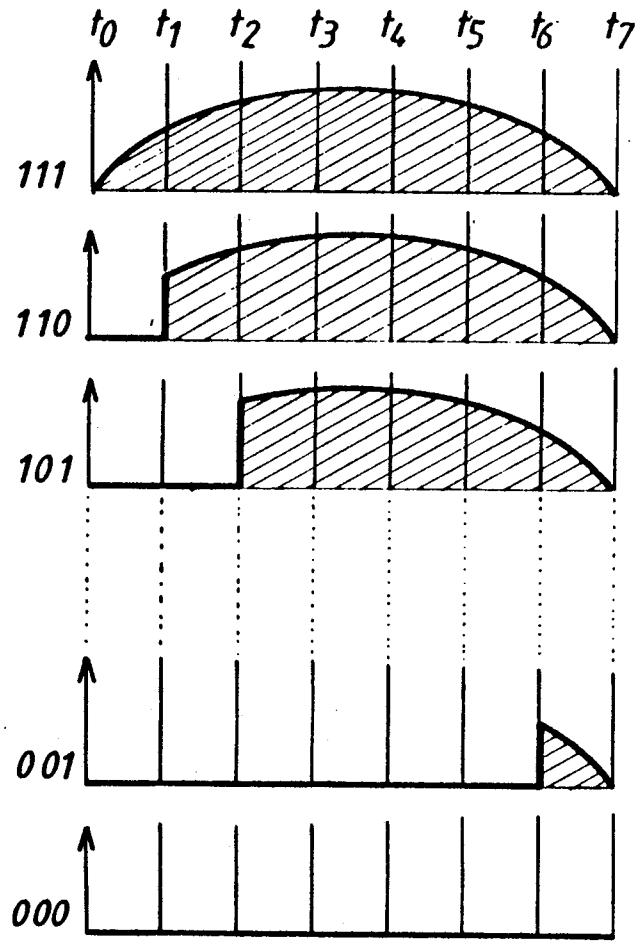
FIG. 8F is a graphical representation showing the resulting waveforms of the wave conducted by the different 3-bit data.

Then, a period of a wave (for a 60 Hz AC current, the period of the wave is 16 msec) is divided into seven equal intervals, each interval being 2.38 msec (See FIG. 8E). When the brightness data is 111 (brightest), the wave is conducted at $t_0$. Thus the bulb string receives the greatest power supply and is therefore giving the greatest brightness. When the brightness data is 110 (the next brightest), the wave is conducted. From FIG. 8F, we can see that a small portion of the wave is shaved (between $t_0$ to $t_1$), so the brightness is slightly weaker than that of the greatest brightness. When the brightness data is 000 (dark), the conducting time of the wave is $t_7$. Thus the effective power supply is 0.

The brightness data are decoded and converted into corresponding signals of different phases of the wave by means of well known circuit which can be integrated in an IC. The corresponding signal is applied to the gate of a SCR to control the conducting angel of the wave supplied to a corresponding string of bulbs. As soon as the signal is applied to the gate of the SCR (the moment can be $t_0$, $t_1$, . . . or $t_7$), the SCR is conducted, therefore allowing the wave to pass through its AK route.

In this method, the corresponding signals applied to the gate of the SCR must be accurately synchronous with the wave. In other words, the signal corresponding to the brightness data 111 must be accurately applied from the IC to the gate of SCR when $t=t_0$, and the signal corresponding to the brightness data 000 must be applied from the IC to the gate of SCR accurately when $t=t_7$, and so do the remaining corresponding signals. Thus the oscillation of the decoder circuit must have the same frequency and the same phase as the wave. The synchronous oscillating wave for the brightness control circuit is shown in FIG. 8C.

(B) Relative Frequency Method

Figure 9A:
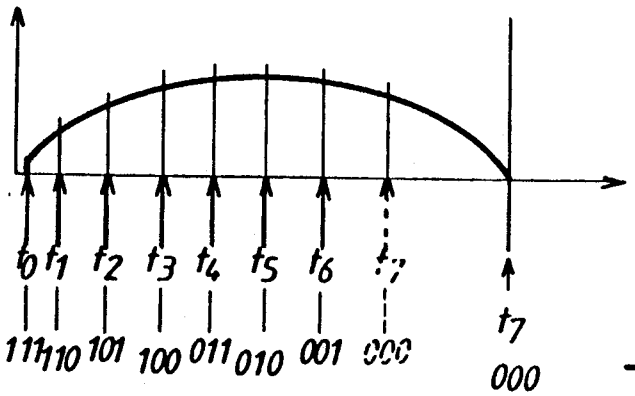
FIGS. 9A and 9B are the graphical representation showing the conducting time of a wave of the relative frequency method in two different cases.
Figure 9C:
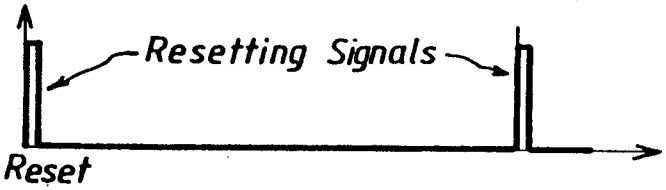
FIG. 9C is a waveform diagram of the synchronous resetting signals for the relative frequency method.
Figure 9B:
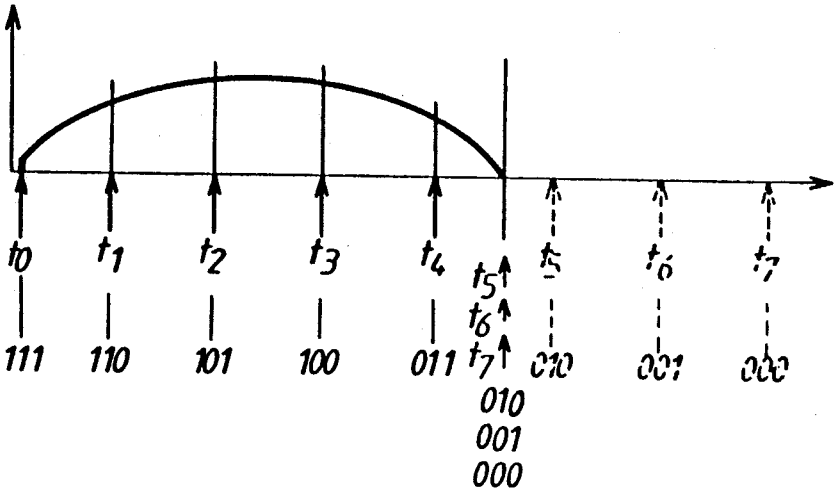
Figure 9E:
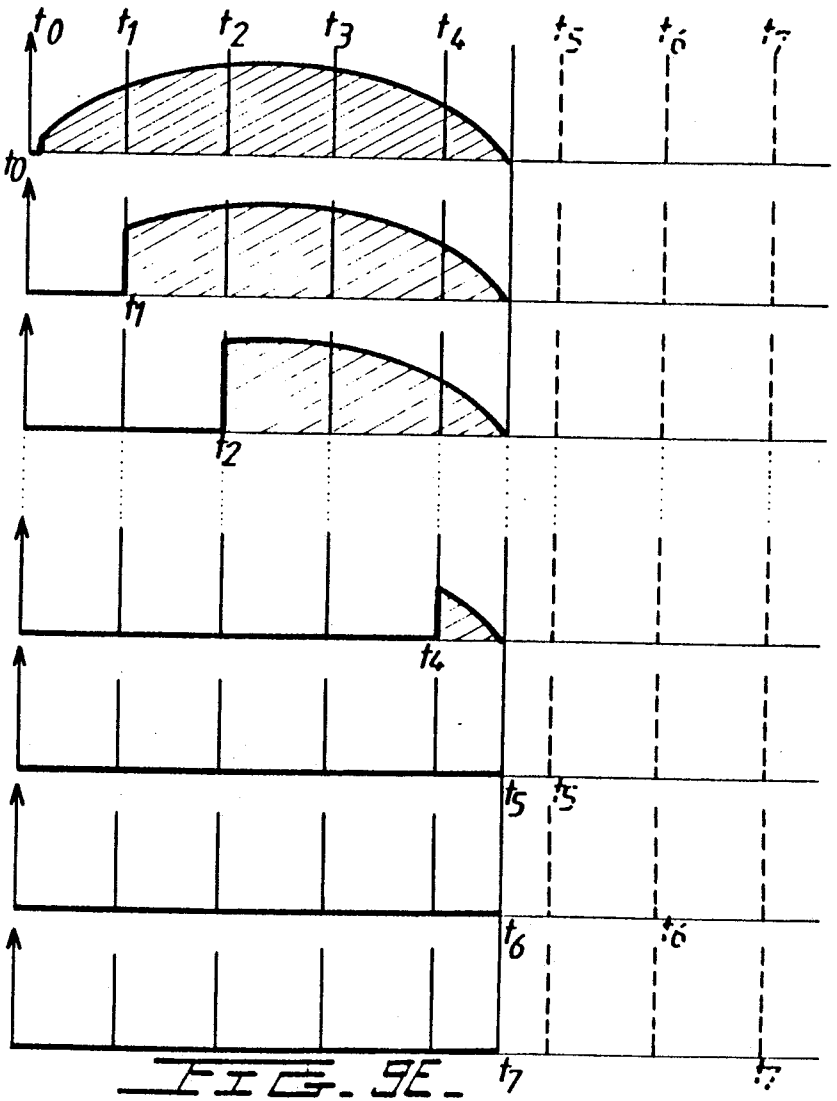
FIGS. 9D and 9E are the graphical representations corresponding to FIGS. 9A and 9B, showing the resulting waveforms of the wave conducted by the different 3-bit data.
Figure 9D:
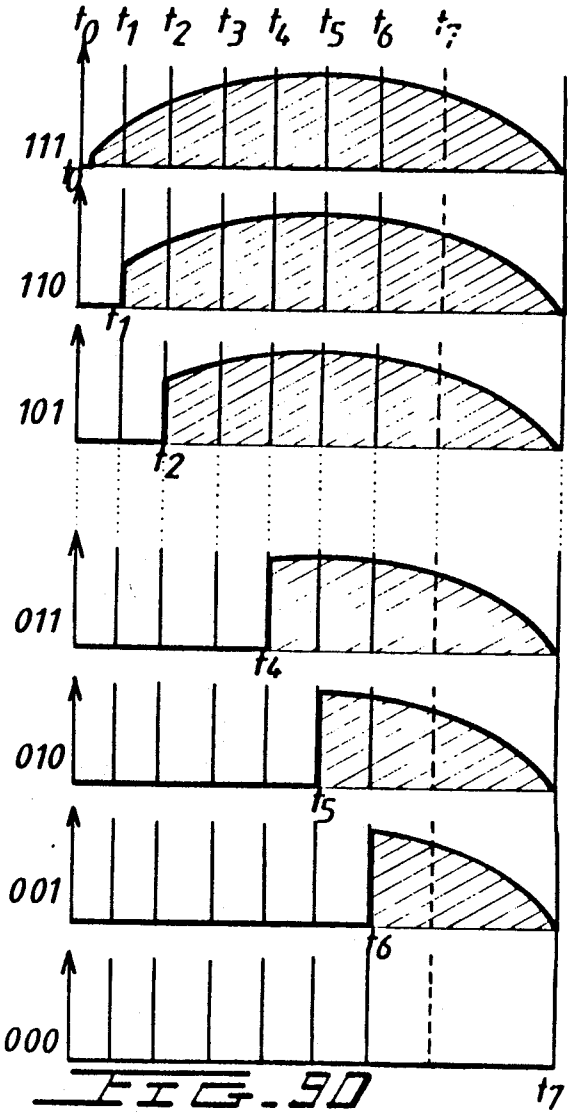
Figure 9F:
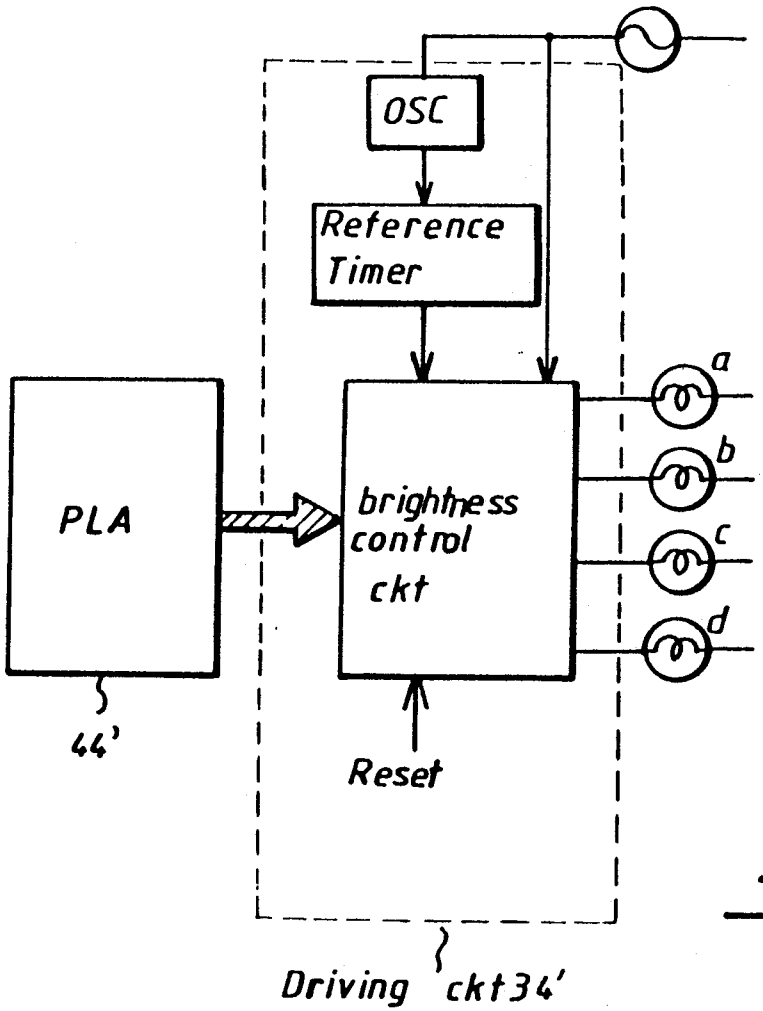
FIG. 9F is a block diagram of a circuit for the relative frequency method.

FIG. 9F shows a circuit to realize the relative frequency method. According to this method, the oscillation of the brightness control circuit is not necessary to be of the same frequency and same phase as the wave. Thus a certain tolerance, for example, a 30% tolerance is allowed. Referring to FIGS. 9A to 9E, the signals corresponding to the brightness data are synchronized by means of a synchronous resetting signal which is produced at the beginning of each wave. It should be noted that the signal corresponding to the brightness data 111 is not applied accurately at the beginning of the wave, but lagged by a very short moment, i.e. the signal corresponding to the brightness data 111 is applied to the brightness control circuit immediately after the end of the resetting signal. Thus, the signal corresponding to the brightness data 111 is not disabled by the resetting signal, and can cause the wave to be conducted for the most time of its half cycle. The remaining signals which corresponds to the remaining brightness data 110, 101, . . . , 000 may be located at the left side (See FIG. 9A) or the right side (See FIG. 9B) of the correct position they are supposed to be located because of the ±30% tolerance. For example, in FIG. 9A the distance between $t_0$ and $t_1$ is smaller than the distance between the $t_0$ and the $t_1$ in FIG. 8C, while in FIG. 9B the distance between $t_0$ and $t_1$ is greater than that in FIG. 8C.

As can be seen in FIG. 9A, the conducting time $t_7$ which corresponds to the brightness data 000 does not fall at the end of a wave. However, because of the circuit, the brightness data 000 is delayed until the end of the wave. Thus the brightness data 000 still corresponds to the OFF of the bulb string (i.e. "zero current").

Referring to FIGS. 9B and 9E, at the end of the wave, the synchronous resetting signal appears and causes a resetting. Thus the signals corresponding to the image data 010, 001 and 000 which are supposed to appear in the time $t_5$, $t_6$ and $t_7$ are disabled and have no chance to be applied to the SCR to conduct the latter. In other words, all the three brightness data 010, 001 and 000 correspond to the OFF of the bulb string.

I claim:

1. A device for controlling a display with a plurality of strings of light-emitting elements to give a dynamic process resulting from the changes of optical states of said strings of light emitting elements of said display, said dynamic process comprising a plurality of patterns which are displayed one by one sequentially, each of said patterns comprising a plurality of images which are displayed one by one sequentially, each of said images corresponding to a definite specific state of said display represented by the optical state of said strings of light emitting elements, all the light emitting elements in each of said strings being connected in series, said device comprising a timing generator for producing periodical clocks of period tu, a driving circuit which has a plurality of outputs, each of which is connected to one of said strings of light-emitting elements to control the optical state thereof, a read only memory having a plurality of ROM-addresses, and a first address counter for said read only memory to count said ROM-addresses, said device being characterized by further comprising a first divider means, a second divider means, a programmable logic array having a plurality of matrical positions to store at most the data corresponding to said patterns, each of said matrical positions having a plurality of PLA-position-addresses to store the data of said images of one of said patterns, and a second address counter for said programmable logic array to count said PLA-position-addresses, each of said ROM-addresses storing three data including:

a first datum (X, Y) corresponding to one of said matrical position $P_{XY}$ where a desired pattern is stored, a second datum Z corresponding to a total duration of a repeated displaying of said desired pattern, a third datum W corresponding to a displayed interval of an image, outputs of said timing generator being respectively connected to inputs of said first and said second divider means, outputs of said first and said second divider means being respectively connected to inputs of said first and second address counters, outputs of said read only memory being respectively connected to said programmable logic array and said first and said second divider means, output of said programmable logic array being connected to said driving circuit, said read only memory being such that when the address count in said first address counter is C, said first, second and third data (X,Y), Z and W in the Cth ROM-address of said read only memory are respectively transmitted to said programmable logic array, said first divider means and said second divider means, thus a corresponding signal is transmitted to the corresponding matrical position $P_{XY}$ of said programmable logic array corresponding to said first datum (X, Y) in said Cth address of said read only memory, so that the pattern stored in said matrical position $P_{XY}$ corresponding to the Cth address of said read only memory is displayed from at least one time to a plurality of times on said display for a duration of Ztu with the displayed interval for each image of said pattern equal to Wtu, said programmable logic array being such that when the address count in said second address counter is L, the data of the image of said pattern stored in the Lth PLA-position-address of said matrical position $P_{XY}$ is sent to said driving circuit when a pulse is sent from said second divider means to said programmable logic array.

2. A device as set forth in claim 1, wherein at least one of said first and second divider means is a programmable counter.

3. A device as set forth in claim 1, wherein at least one said first and second divider means is a multiplexer.

4. A device as set forth in claim 1, wherein said light emitting elements are bulbs.

5. A device as set forth in claim 1, wherein said changes of optical states of said display are the ON/-OFF of said light-emitting elements from an image to another image.

6. A device as set forth in claim 1, wherein said changes of optical states of said display are the changes in the brightness of said light-emitting elements from an image to another image, said brightness of said light-emitting elements ranging from totally dark to the brightest degree thereof.

7. A device as set forth in claim 6, wherein said brightness of said light-emitting elements is divided into K degrees, each of which is represented by an I-bit binary code, wherein K and I are positive integers, and K is not greater than the Ith power of 2.

8. A device as set forth in claim 7, wherein the datum of each string of an image in a pattern is stored in an PLA-position address of one of said matrical positions of said programmable logic array in form of said binary code.

* * * * *